United States Patent [19]

Upchurch

[11] Patent Number: 4,796,699

[45] Date of Patent: Jan. 10, 1989

[54] WELL TOOL CONTROL SYSTEM AND METHOD

[75] Inventor: James M. Upchurch, Sugarland, Tex.

[73] Assignee: Schlumberger Technology Corporation, Houston, Tex.

[21] Appl. No.: 198,968

[22] Filed: May 26, 1988

[51] Int. Cl.[4] ..... E21B 34/10; E21B 47/06; E21B 49/08

[52] U.S. Cl. ..... 166/250; 166/53; 166/64; 166/66.4; 166/264; 166/319; 166/374

[58] Field of Search ..... 166/250, 374, 319, 321, 166/332, 65.1, 66.4, 264, 53; 175/4.56; 367/83; 340/861

[56] References Cited

U.S. PATENT DOCUMENTS

| | | | |
|---|---|---|---|
| 3,780,809 | 12/1973 | Ayers, Jr. et al. | 166/374 |
| 3,823,773 | 7/1974 | Nutter | 166/250 X |
| 3,863,714 | 2/1975 | Watson, Jr. | 166/53 |
| 4,150,721 | 4/1979 | Norwood | 166/53 |
| 4,215,746 | 8/1980 | Hallden et al. | 166/66.4 X |
| 4,375,239 | 3/1983 | Barrington et al. | 166/374 X |
| 4,403,659 | 9/1983 | Upchurch | 166/374 |
| 4,421,174 | 12/1983 | McStravick et al. | 166/374 |
| 4,442,902 | 4/1984 | Doremus et al. | 166/374 |
| 4,657,082 | 4/1987 | Ringgenberg | 166/374 X |

*Primary Examiner*—Stephen J. Novosad

*Attorney, Agent, or Firm*—Henry N. Garrana; John H. Bouchard

[57] ABSTRACT

In accordance with illustrative embodiments disclosed herein, a formation testing tool suspended in a well on a pipe string includes a valve actuator control system which responds to a command signal having a certain signature. The command signal is applied at the surface to the well annulus, and includes a series of two or more low level pressure pulses which are detected at the downhole tool, each pressure pulse having, for example, a certain peak value which lasts for a certain time. On detection of the command signal, a control system within the testing tool permits selective application of hydrostatic pressure which forces the valve actuator to shift from one position to another, thereby to open or close an associated valve element.

44 Claims, 6 Drawing Sheets

WELL TOOL CONTROL SYSTEM AND METHOD

FIELD OF THE INVENTION

This invention relates generally to methods and apparatus for controlling the operation of downhole well tools from the surface, and particularly to a new and improved downhole tool control system that responds to command signals having a certain signature applied at the surface to fluids in the well and causes movement of a valve actuator which, in turn, opens or closes a valve device.

BACKGROUND OF THE INVENTION

It has become common practice to perform well service operations, such as formation testing and evaluation, using pressure controlled valve devices such as those shown in the Nutter U.S. Pat. No. Re. No. 29,638 issued May 28, 1978 and assigned to the assignee of this invention. Other related devices are illustrated, for example, in Nutter U.S. Pat. Nos. 3,823,773 issued July 16, 1974, and 3,986,554 issued Oct. 19, 1976, as well as in my U.S. Pat. Nos. 4,403,659 issued Sept. 13, 1983, 4,479,242 issued Oct. 2, 1984, and 4,576,234 issued Mar. 18, 1986, all assigned to the assignee of this invention. All of these devices are valve structures that are operably responsive to changes in the pressure of fluids that stand either in the tubing-to-casing annulus, or in the tubing. These tools have been used quite successfully in testing cased well bores where a high level pressure signal can be applied safely to the annulus fluids. However some very deep, cased wells are not tested with pressure controlled tools because the operating pressure might exceed the burst rating of the casing. Moreover, testing in open (uncased) boreholes has not been done with standard pressure controlled tools for fear that operating pressures might break down the exposed formations and cause damage to their productive capabilities. Certain types of valve devices, such as circulating valves, have required comparatively long operating times due to the complicated series of annulus or tubing pressure changes that are required to cycle the tool from closed to open position, and to reclose it, if desired. Inherent in such designs has been increased length, to the point where a typical combination of tester, sampler and circulating valves might well have an overall length in excess of 100 feet. Of course increased complexity of valve systems generally reduces reliability, and increases the chances of misruns. Nevertheless, there is a continuing need in this industry to increase the number of service operations that can be performed downhole in a single trip of the well testing tool string into the well. With the foregoing limitations and industry needs in mind, I have invented the downhole tool control system disclosed and claimed in this application.

A general object of the present invention is to provide a new and improved control system for downhole pressure operated tools that is operably responsive to low level pressure change signals, as thus has application to all types of wells including deep cased wells and open hole.

Another object of the invention is to provide a new and improved downhole device control system that includes a power source and command module which enables numerous sequences of valve operation to be performed on a single run.

Another object of the present invention is to provide a new and improved remote controlled downhole valve system that does not require long operating times or a complicated sequence of annulus or tubing pressure applications.

Still another object of the present invention is to provide a new and improved pressure responsive well testing tool that has a relatively short length, and which is simple and reliable in operation.

SUMMARY OF THE INVENTION

These and other objects are attained in accordance with the present invention through the provision of a tubular housing having a pressure responsive actuator mandrel movable therein between longitudinally spaced positions. Longitudinal movement of the actuator mandrel is used, for example, to cause shifting of an associated valve element between open and closed positions with respect to a flow passage, such passage being either internally of the housing, or through the side wall thereof. The mandrel includes a piston surface on which a pressurized working medium acts to develop a longitudinal actuating force, and the working medium is supplied from a chamber in the housing at a pressure substantially equal to the hydrostatic pressure of well fluids externally of the housing.

The working medium is selectively supplied to the actuator piston via a system of control valves that are operably responsive to a battery-powered controller that is located in the housing. The actuator mandrel remains in one of its positions unless and until a command signal is received by the controller. In accordance with one aspect of the invention, such command signal is a sequence of low level pressure pulses applied at the surface to the well annulus, such signal having a "signature" or characteristic by which it can be identified. For example, and not by way of limitation, each low level pressure pulse can have a peak value that continues for a specified duration. When a command signal is received, the controller causes the system of control valves to assume various states, whereby working medium under pressure is supplied to the actuator piston to thereby develop the force necessary to cause the actuator to shift from one position to another. The actuator mandrel is returned to its original position in response to another command signal, with working medium being dumped to a low pressure chamber in the housing during such return movement. In one embodiment, return movement of the actuator mandrel is caused by a spring, and in another embodiment the return movement is forced by working medium under pressure acting on the opposite side of the actuator piston. In the second-mentioned embodiment, the control valve system and controller function to cause working medium to be dumped from the opposite side of the piston to the low pressure chamber as the actuator mandrel is shifted back to its initial position.

The duration of each low level pressure pulse in the command signal can be relatively short, for example, 30 seconds. Where a series of such pulses are employed, only a few seconds need intervene between applied pulses. The pressure pulses are relatively low in magnitude, and can be in the order of only about 500 psi or less. The power needed to operate the system is located entirely downhole, and the pressures used to shift the actuator mandrel are derived entirely from a downhole source, namely the hydrostatic head pressure of fluids standing in the well bore. Since only low level pressure pulses or signals are applied to the annulus to cause a change in downhole valve state, the invention can be used in all wells including deep cased wells, as well as open hole. A large number of valve element cycles is possible through use of the system of the present invention, whereby an increased number of well services can be performed in a single trip into the well. Overall operating time is reduced, and complicated and lengthy sequence of high level annulus pressure applications are eliminated. The inventive system disclosed herein is relatively simple and compact, which permits the lengths of prior art tool components to be considerably shortened. Increased reliability also is achieved.

BRIEF DESCRIPTION OF THE DRAWINGS

The present invention has other objects, features and advantages which will become more clearly apparent in connection with the following detailed description of preferred embodiments, taken in conjunction with the appended drawings in which.

DETAILED DESCRIPTION OF PREFERRED EMBODIMENTS

Figure 1:
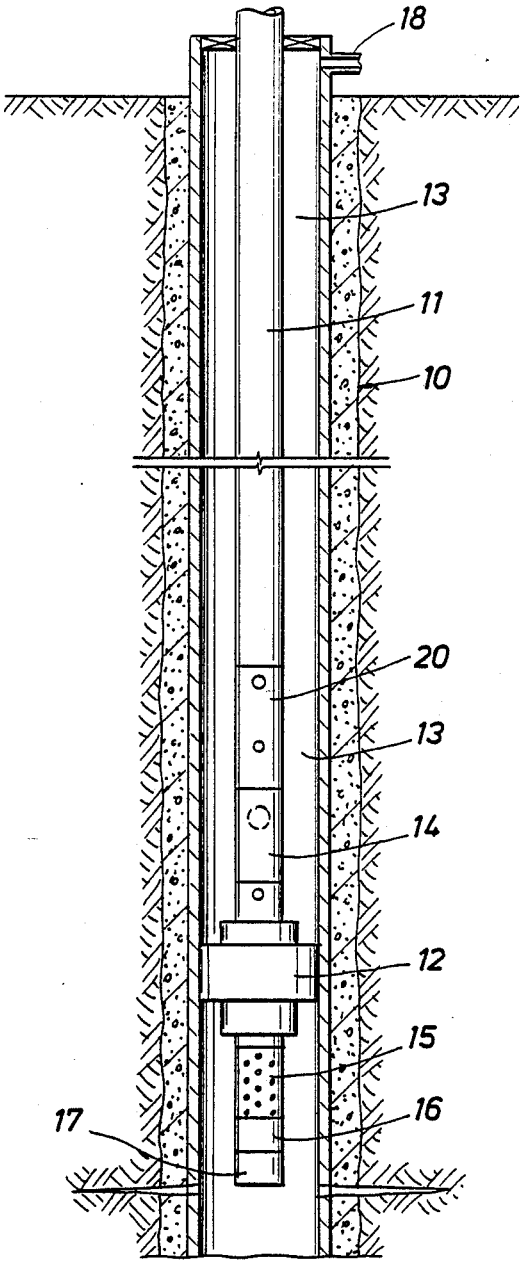
FIG. 1 is a schematic view of a string of drill stem testing tools positioned in a well being tested.

Referring initially to FIG. 1, a string of drill stem testing tools is shown suspended in well bore 10 on drill pipe or tubing 11. The testing tools comprise a typical packer 12 that acts to isolate the well interval being tested from the hydrostatic head of fluids standing in the annulus space 13 thereabove, and a main test valve assembly 14 that serves to permit or to prevent the flow of formation fluids from the isolated interval into the pipe string 11. The main valve 14 is closed while the tools are being lowered, so that the interior of the tubing provides a low pressure region into which formation fluids can flow. After the packer 12 is set, the valve 14 is opened for a relatively short flow period of time during which pressure in the well bore are reduced. Then the valve 14 is closed for a longer flow period of time during which pressure build-up in the shut-in well bore is recorded. Other equipment components such as a jar and a safety joint can be coupled between the test valve 14 and the packer 12, but are not illustrated in the drawing because they are notoriously well known. A perforated tail pipe 15 is connected to the lower end of the mandrel of the packer 12 to enable fluids in the well bore to enter the tool string, and typical inside and outside pressure recorders 16, 17 are provided for the acquisition of pressure data as the test proceeds.

A circulating valve 20 that has been chosen to illustrate the principles of the present invention is connected in the tool string above the main test valve assembly 14. As shown schematically in FIG. 2, the valve assembly 20 includes an elongated tubular housing 21 having a central flow passage 22. A valve actuator 23 is slidably mounted in the housing 21, and includes a mandrel 24 having a central passage 25 and an outwardly directed annular piston 26 that is sealed by a seal ring 28 with respect to a cylinder 27 in the housing 21. Additional seal rings 29, 30 are used to prevent leakage between the cylinder 27 and the passage 22. The seal rings 29, 30 preferably engage on the same diameter so that the mandrel 24 is balanced with respect to fluid pressures within the passageway 22. A coil spring 32 located in the housing below the piston 26 reacts between an upwardly facing surface 33 at the lower end of the cylinder 27 and a downwardly facing surface 34 of the piston 26. The spring 32 provides upward force tending to shift the mandrel 24 upwardly relative to the housing 21. The annular area 35 in which the spring 32 is positioned contains air at atmospheric or other low pressure. The cylinder area 36 above the piston 26 is communicated by a port 37 to a hydraulic line 38 through which oil or other hydraulic fluid is supplied under pressure. A sufficient pressure acting on the upper face 40 of the piston 26 will cause the mandrel 24 to shift downward against the resistance afforded by the coil spring 32, and a release of such pressure will enable the spring to shift the mandrel upward to its initial position. The reciprocating movement of the mandrel 24 is employed, as will be described subsequently, to actuate any one of a number of different types of valve elements which control the flow of fluids either through the central passage 22 of the housing 21, or through one or more side ports through the walls of the housing 21.

The source of hydraulic fluid under pressure is a chamber 42 that is filled with hydraulic oil. As will be explained below, the chamber 42 is pressurized by the hydrostatic pressure of well fluids in the well annulus 13 acting on a floating piston which transmits such pressure to the oil. A line 43 from the chamber 42 leads to a first solenoid valve 44 which has a spring loaded, normally closed valve element 45 that engages a seat 46. Another line 47 leads from the seat 46 to a line 48 which communicates with a first pilot valve 50 that functions to control communication between a hydraulic line 51 that connects with the actuator line 38 and a line 52 that also leads from the high pressure chamber 42. A second solenoid valve 53 which also includes a spring loaded, normally closed valve element 54 engageable with a seat 55 is located in a line 56 that communicates between the lines 47, 48 and a dump chamber 57 that initially is empty of liquids, and thus contains air at atmosphere on other low pressure.

The pilot valve 50 includes a shuttle element 60 that carries seal rings 61, 62, and which is urged toward a position closing off the cylinder line 51 by a coil spring 63. However when the second solenoid valve 53 is energized open by an electric current, the shuttle 60 will shift to its open position as shown, hydraulic fluid behind the shuttle 60 being allowed to exhaust via the lines 48 and 56 to the low pressure dump chamber 57. With the pilot valve 50 open, pressurized oil from the chamber 42 passes through the lines 52, 51 and 38 and into the cylinder region 36 above the actuator piston 26. The pressure of the oil, which is approximately equal to hydrostatic pressure, forces the actuator mandrel 24 downward against the bias of the coil spring 32.

Figure 2:
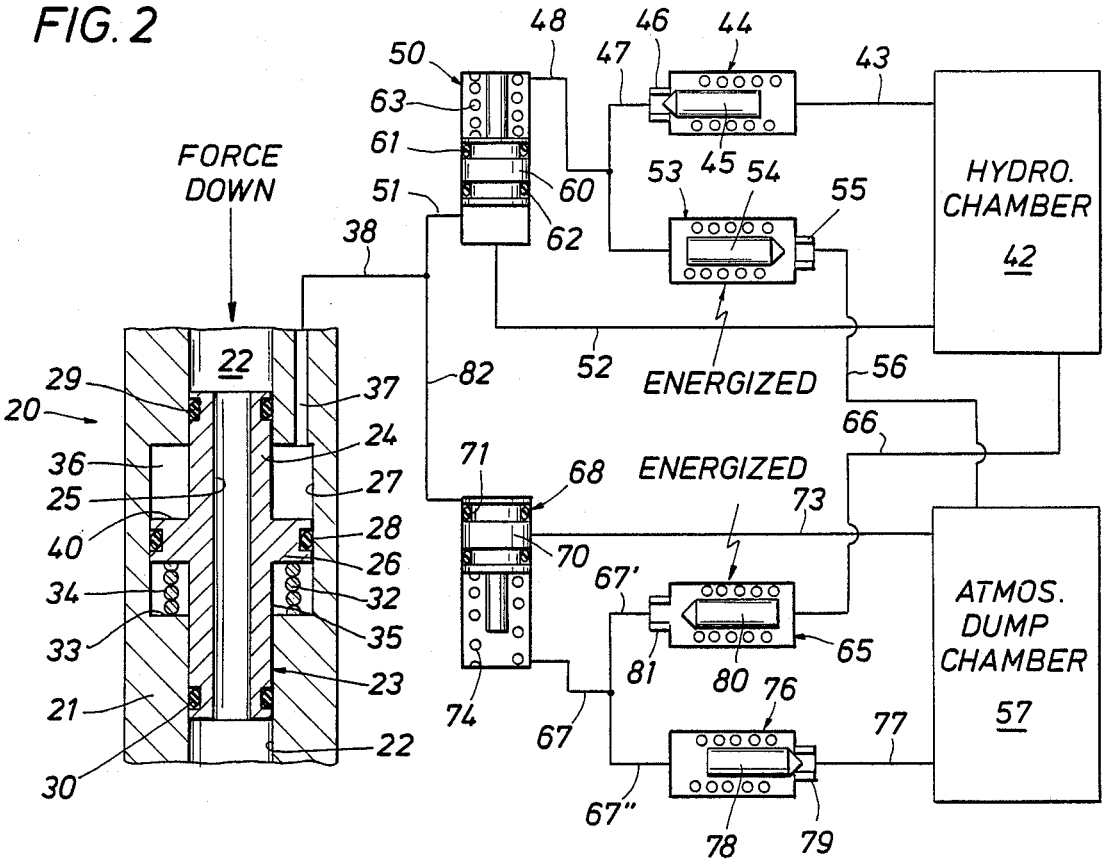
FIG. 2 is a schematic view of the hydraulic components of the present invention.

The hydraulic system as shown in FIG. 2 also includes a third, normally closed solenoid valve 65 located in a line 66 that extends from the chamber 42 to a line 67 which communicates with the pressure side of a second pilot valve 68. The pilot valve 68 also includes a shuttle 70 that carries seal rings 71, 72 and which is urged toward its closed position by a coil spring 74, where the shuttle closes an exhaust line 73 that leads to the dump chamber 57. A fourth, normally closed solenoid valve 76 is located in a line 77 which communicates between the pressure line 67 of the pilot valve 68 and the dump chamber 57. The solenoid valve 76 includes a spring biased valve element 78 that coacts with a seat 79 to prevent flow toward the dump chamber 57 via the line 77 in the closed position. In like manner, the third solenoid valve 65 includes a spring-loaded, normally closed valve element 80 that coacts with a seat 81 to prevent flow of oil from the high pressure chamber 42 via the line 66 to the pilot input line 67 except when opened, as shown, by electric current supplied to its coil. When the solenoid valve 65 is open, oil under pressure supplied to the input side of the pilot valve 68 causes the shuttle 70 to close off the dump line 73. Although high pressure also may be present in the line 82 which communicates the outer end of the shuttle 70 with the lines 51 and 38, the pressures in lines 67 and 82 are equal, whereby the spring 74 maintains the shuttle closed across the line 73. Although functionally separate pilot valves have been shown, it will be recognized that a single three-way pilot valve could be used.

In order to permit the power spring 12 to shift the actuator mandrel 24 upward from the position shown in FIG. 2, the first and fourth solenoid valves 44 and 76 are energized, and the second and third solenoid valves 53 and 65 simultaneously are de-energized. When this occurs, the solenoid valves 53 and 65 shift to their normally closed positions, and the valves 44 and 76 open. The opening of the valve element 45 permits pressures on opposite sides of the shuttle 60 to equalize, whereupon the shuttle 60 is shifted by its spring 63 to the position closing the cylinder line 51. The valve element 54 of the solenoid valve 53 closes against the seat 55 to prevent pressure in the chamber 42 from venting to the dump chamber 57 via the line 56. The closing of the valve element 80 and the opening of the valve element 78 communicates the pilot line 67 with the dump chamber 57 via line 77, so that high cylinder pressure in the lines 38 and 82 acts to force the shuttle 70 to shift against the bias of the spring 74 and to open up communication between the lines 82 and 73. Thus hydraulic fluid in the cylinder region 36 above the piston 26 is bled to the dump chamber 57 as the power spring 32 extends and forces the actuator mandrel 20 upward to complete a cycle of downward and upward movement. The solenoid valves 44, 53, 65, and 76 can be selectively energized in pairs, as described above, to achieve additional cycles of actuator movement until all the hydraulic oil has been transferred from the chamber 42 to the dump chamber 57. Of course the actuator mandrel 20 is maintained in either its upward or its downward position when all solenoid valves are de-energized.

As will be described below with reference to the various drawings which constitute FIG. 5, working medium under pressure can be supplied to the region 35 below the piston 26 to force upward movement of the actuator mandrel 24. In that event the spring 32 need not be used, and another set of pilot valves and solenoid valves as shown in FIG. 2 could be used.

Figure 3:
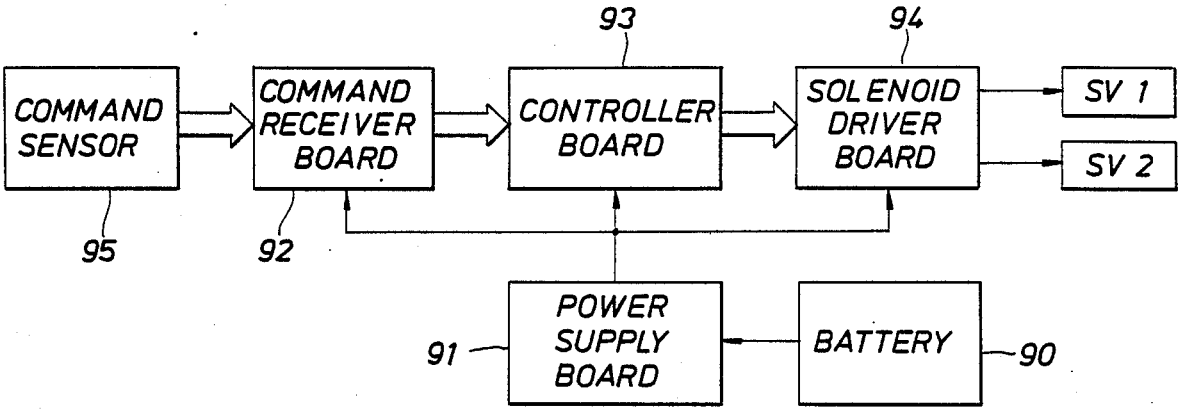
FIG. 3 is a block diagram of the control components used to operate the hydraulic system of FIG. 2.

A control system for selectively energizing the solenoid valves 43, 53, 65 and 76 is shown schematically in FIG. 3 by way of a functional block diagram. The various components illustrated in the block diagram are all mounted in the walls of the housing 21 of the circulating valve 20, as will be explained subsequently in connection with FIGS. 5A–5F. One or more batteries 90 feed a power supply board 91 which provides electrical power output to a command receiver board 92, a controller board 93 and a solenoid driver board 94. The command signal applied at the surface to the well annulus 13 is sensed by a transducer 95, which supplies an electrical signal representative thereof to the receiver board 92. The receiver board 92 functions to convert a low level electrical signal from the transducer 95 into an electrical signal of a certain format, which can be interrogated by the controller board 93 to determine whether or not at least one, and preferably two or more, electrical signals representing the command signature are present in the output of the sensor 95. If, and only if, such is the case, controller board 93 supplies an output signal which triggers operation of the driver board 94 which enables the driver to supply electric current to selected pairs of the solenoid valves 43, 53, 65 and 76, the pairs being indicated schematically as SV-1 and SV-2 in the drawing.

Figure 4:
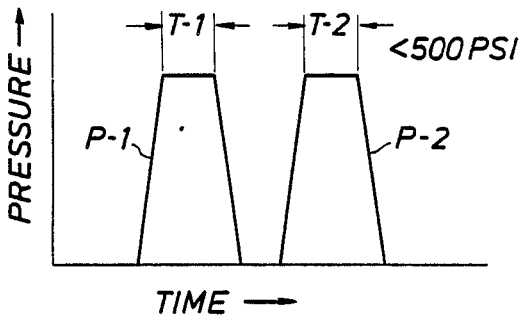
FIG. 4 is a pressure-time diagram to illustrate a command signal comprising a sequence of low level pressure pulses.

FIG. 4 is a pressure-time diagram which illustrates one embodiment of command signal which will initiate valve operation. As shown, the signal is in the form of a series of low level pressure pulses P-1, P-2. The pressure pulses P-1 and P-2 are applied at the surface to the fluids standing in the well annulus 13 via the line 18 as shown in FIG. 1, with each pressure pulse being applied for a definite time period, and then released. Such time periods are illustrated as T-1 and T-2 in the drawing. These discrete pressure pulses are separated by short time intervals as indicated, however the lengths of such intervals are not significant in the embodiment shown. The levels of the applied pressure pulses are relatively low, and for example need not exceed 500 psi. The duration of the peak value T-1, T-2 of each pulse can be quite short, for example 30 seconds. However unless and until the receiver 92 is provided with an output signal from the transducer 95 that includes voltages that rise to a certain level and are maintained at that level for the prescribed time periods, the controller 93 does not provide outputs to the driver 94. In this way, spurious or random pressure increases or changes that might occur as the tools are lowered, and the like, are discriminated against, and do not trigger operation of the control system. A single pressure pulse P-1 could be used to trigger the controller 93, however a requirement of a series of at least two such pulses is preferred.

It will be recognized that a number of features of the present invention described thus far coact to limit power requirements to a minimum. For example, the solenoid valves are normally closed devices, with power being required only when they are energized and thus open. The controller board 93 does not provide an output unless its interrogation of the output of receiver 92 indicates that a command signal having a known signature has been sensed by the transducer 95. Then of course the driver 94 does not provide current output to a selected pair of the solenoid valves unless signalled to do so by the controller board 93. In all events, the only electrical power required is that necessary to power the circuit boards and to energize solenoid valves, because the forces which shift the actuator mandrel 24 are derived from either the difference in pressure between hydrostatic and dump chamber pressures, or the output of the spring 32. Thus the current drain on the batteries 90 is quite low, so that the system will remain operational for extremely long periods of downhole time.

The structural details of a circulating valve assembly 20 that is constructed in accordance with the invention are shown in detail in FIGS. 5A-5F. The circulating valve assembly 20 includes an elongated tubular housing, indicated generally at 100, comprising an upper sub 101 having one or more circulating ports 102 that extend through the wall thereof. Threads 103 at the upper end of the sub 101 are used to connect the housing 100 to the lower end of the tubing 11, or to another tool string component thereabove. The upper sub 101 is threaded at 99 (FIG. 5B) to the upper end of an adapter sleeve 104, which is, in turn, threaded at 105 to the upper end of a tubular dump chamber member 106. The member 106 is threadedly connected to a tubular oil chamber member 107 (FIG. 5C) by an adapter sleeve 108, and the lower end of the member 107 is threaded at 109 (FIG. 5D) to the upper end of a pilot and solenoid valve sub 110. The sub 110 is threaded to another tubular member 11 (FIG. 5E) which houses the pressure transducer 95, as well as all the various circuit boards discussed above in connection with FIG. 3. Finally the member 11 has its lower end threaded at 112 to the upper end of a battery carrier sub 113 which houses one or more batteries 90 in suitable recesses 114 in the walls thereof. The lower end of the battery sub 113 has pin threads 115 (FIG. 5F) by which the lower end of the housing 100 can be connected to, for example, the upper end of the main tester valve assembly 14.

Referring again to FIGS. 5A and 5B, the upper housing sub 101 is provided with stepped diameter internal surfaces that define a central passage 22, a seal bore 117, and a cylinder bore 118. An actuator mandrel 24 having an outwardly directed piston section 26 is slidably disposed within the sub 101, and carries seal rings 30, 28 and 29 which seal, respectively, against the seal bore 117, the cylinder wall 118 and a lower seal bore 120 that is formed in the upper end portion of the adaptor 104. The diameters of sealing engagement of the rings 30 and 29 preferably are identical, so that the mandrel 24 is balanced with respect to internal fluid pressures. An oil passage 37 leads via a port 122 to the cylinder region 36 above the piston 26, and is communicated by ports 123 to a continuing passage 37A that extends downward in the adapter sub 104. Seals 124 prevent leakage at the ports 123, as well as past the threads 99.

In the embodiment shown in FIG. 2, downward force on the mandrel 24 is developed by pressurized oil in the cylinder region 36, with upward force being applied by the spring 32 which is located in an atmospheric chamber 35. In the embodiment shown in FIGS. 5A-5F, upward force on the mandrel 24 also is developed by pressurized oil which is selectively applied to a cylinder region 126 below the piston 26. Of course both embodiments are within the scope of the present invention. Where pressurized oil is employed to develop force in each longitudinal direction, another oil passage 125 extends from the cylinder region 126 below the piston 26 downward in the adapter sub 104, as shown in solid and phantom lines on the left side of FIG. 5B. Although not explained in detail, the structure for extending the passage 125 downward in the housing 100 to the control valve sub is essentially identical to that which is described respecting the passage 37.

The oil passage 37A crosses over at ports 126 to another passage 37B which is formed in the upper section 128 of a transfer tube 130. The section 128 carries seal rings 131–133 to prevent fluid leakage, and the lower end of the passage 37B is connected to a length of small diameter patch tubing 134 which extends downward through an elongated annular cavity 57 formed between the outer wall of the transfer tube 130 and the inner wall of the chamber sub 106. The cavity 57 forms the lower pressure dump chamber described above with reference to FIG. 2, and can have a relatively large volume, for example 150 cubic inches in the embodiment shown. The lower end of the patch tube 134 connects with a vertical passage 37C (FIG. 5C) in the lower section 136 of the transfer tube 130, which crosses out again at ports 139 which are suitably sealed as shown, to a passage 37D which extends downward in the adapter sub 108. Near the lower end of the sub 108, the passage crosses out again at ports 137 to an oil passage 37E which extends downward in the wall of the oil chamber sub 107.

An elongated tube 140 is positioned concentrically within the sub 107 and arranged such that another elongated annular cavity 42 is formed between the outer wall surface of the tube and the inner wall surface of the sub. The cavity 42 forms the high pressure oil chamber shown schematically in FIG. 3, and also can have a volume in the neighborhood of 150 cubic inches. Outer seal rings 143–146 seal against the chamber sub 108 adjacent the ports 137, and inner seal rings 147 seal against the upper end section of the tube 140.

Figure 5A:
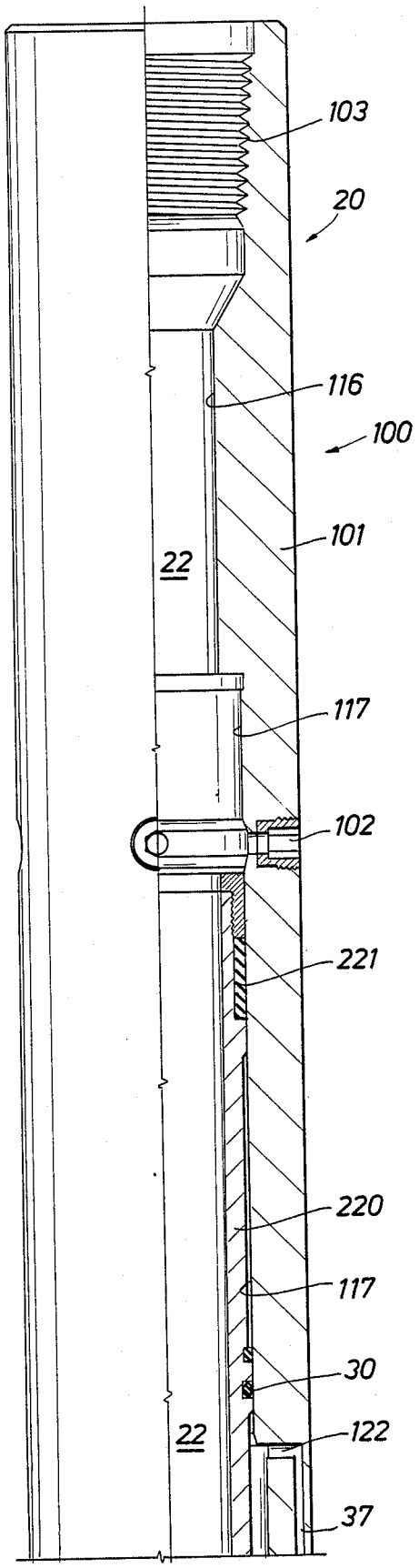
FIGS. 5A–5F are longitudinal sectional views, with some portions in side elevations, of a circulating valve component of a drill stem testing string constructed in accordance with this invention (the upper portion of FIG. 5D being rotated with respect to the lower portion thereof of show pressure passages in section)
Figure 5B:
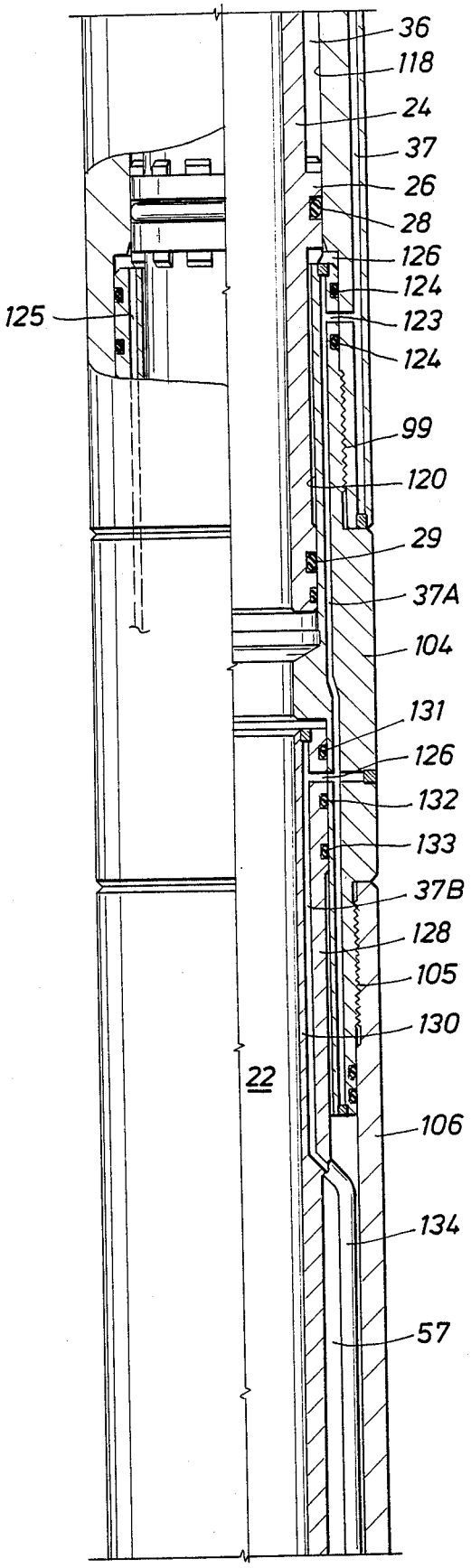

A hydrostatic pressure transfer piston 150 in the form of a ring member that carries inner and outer seals 156, 157 is slidably mounted within the annular chamber 42, and is located at the upper end thereof when the chamber is full of oil. The region 151 above the piston 150 is placed in communication with the well annulus outside the housing 100 by one or more radial ports 152. As shown in FIG. 5D, the lower end of the chamber 42 is defined by the upper face of the upper section 153 of a pilot and solenoid valve sub 110, and inner and outer seal rings 155, 154 prevent fluid leakage. The chamber 42 is filled at the surface with a suitable hydraulic oil, and as the tools are lowered into a fluid-filled well bore, the piston 150 transmits the hydrostatic pressure of well fluids to the oil in the chamber 42, whereby the oil always has a pressure substantially equal to such hydrostatic pressure. The dump chamber 57, on the other hand, initially contains air at atmospheric or other relatively low pressure. The difference in such pressures therefore is available to generate forces which cause the valve actuator mandrel 24 to be shifted vertically in either direction, as will be described in more detail below.

Figure 5C:
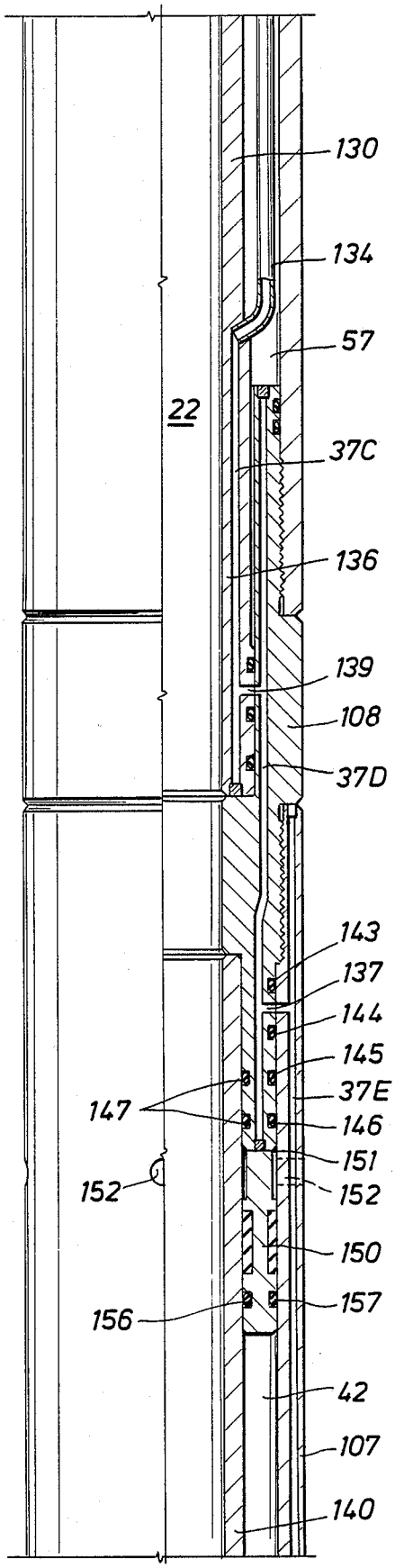
Figure 5D:
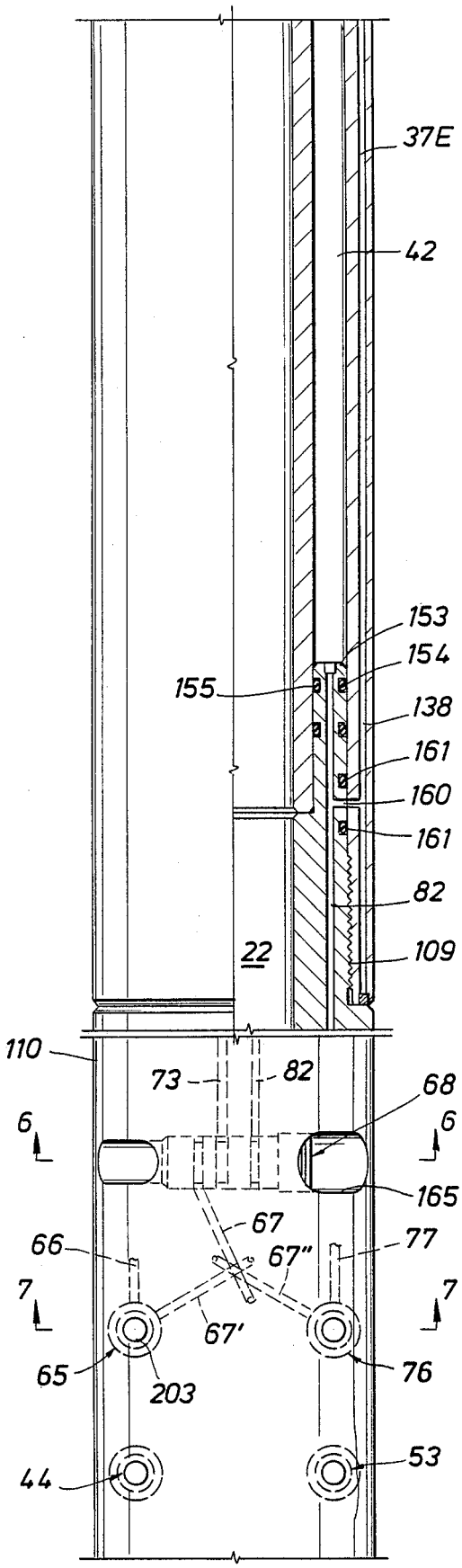
Figure 6:
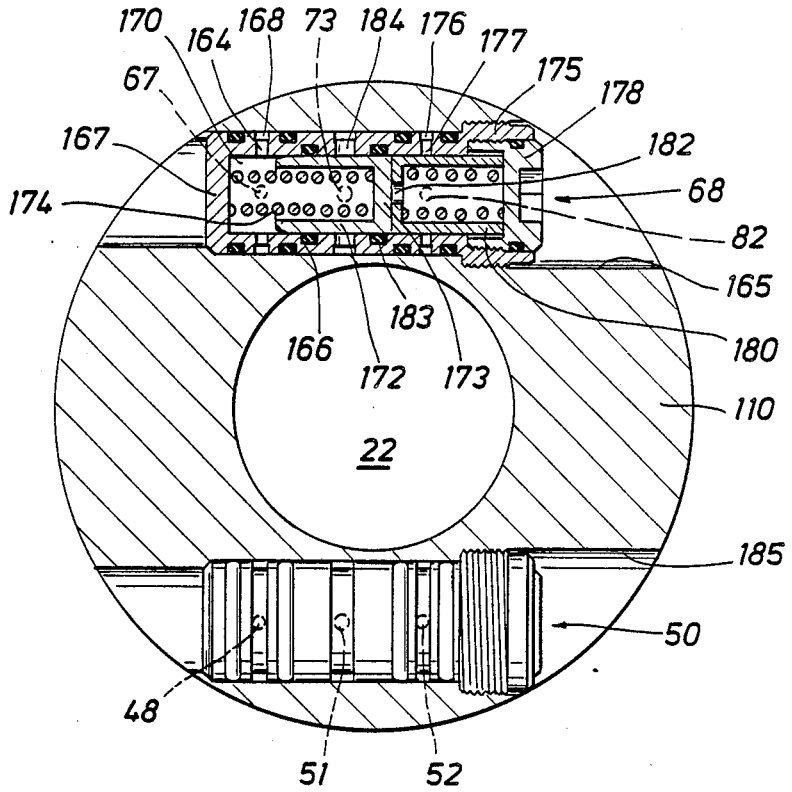
FIGS. 6 and 7 are transverse cross-sectional views taken on lines 6—6 and 7—7, respectively, of FIG. 5D.

As shown in FIG. 5D, the passage 37E crosses inward at ports 160 which are sealed by rings 161 to a vertical passage 82 that extends downward in the valve sub 110, and which intersects a transverse bore 165 that is formed in the wall of the sub 110. The bore 165 receives the pilot valve assembly 68 that has been described generally with reference to FIG. 2. As shown in detailed in FIG. 6, the assembly 68 includes a cylinder sleeve 166 having an outer closed end 167. The cylinder sleeve 166 has an external annular recess 168 that communicates with the passage 67, and ports 169 to communicate the recess with the interior bore 170 of the sleeve. Seal rings are provided as shown to seal the cylinder sleeve 166 with respect to the bore 165. A cup-shaped shuttle piston 172 having a closed outer end 173 is sealingly slidable with respect to the cylinder sleeve 166, and a coil spring 174 urges the piston 172 outwardly of the sleeve 166. A tubular insert 175 which is threaded into the bore 165 in order to hold the cylinder sleeve 166 in place has an external annular recess 176 and ports 177 that communicate the body passage 82 with the interior of the insert 175. The outer end of the insert 175 is closed by a sealed plug 178. Various seal rings are provided, as shown, to seal the insert 175 with respect to the bore 165, and the inner end portion thereof with respect to the piston 172. A seal protector sleeve 180 is slidably mounted in the insert 175 and is urged toward the piston 172 by a coil spring 181. The sleeve 180 has a hole 182 as shown to permit free flow of oil. The leading purpose of the sleeve 180 is to cover the O-ring 183 and keep it in its groove as the piston 172 moves rearward into the cylinder space 170. The inner end portion of the cylinder sleeve 166 can be slotted at 184 to permit free flow of oil through the passage 73 when the piston 172 moves from its closed position, as shown, to its open position where it is telescoped into the cylinder bore 170. The passage 73 is extended upward within the walls of the various component parts of the housing 100 to a location where its upper end opens into the dump chamber 57. This structure is not shown, but is similar to the manner in which the passage 37 is formed, except for being angularly offset therefrom. The other pilot valve assembly 50 described generally with reference to FIG. 2 is mounted in another transverse bore 185 in the wall of the valve sub 110 at the same level as the pilot assembly 68 as shown in FIG. 6. Since the assembly 50 is structurally identical to the assembly 68, a detailed description of the various parts thereof are not repeated to simplify the disclosure. The various passages which intersect the bore 185 are the cylinder passage 51, the supply passage 52 and the pilot pressure port 48.

Figure 7:
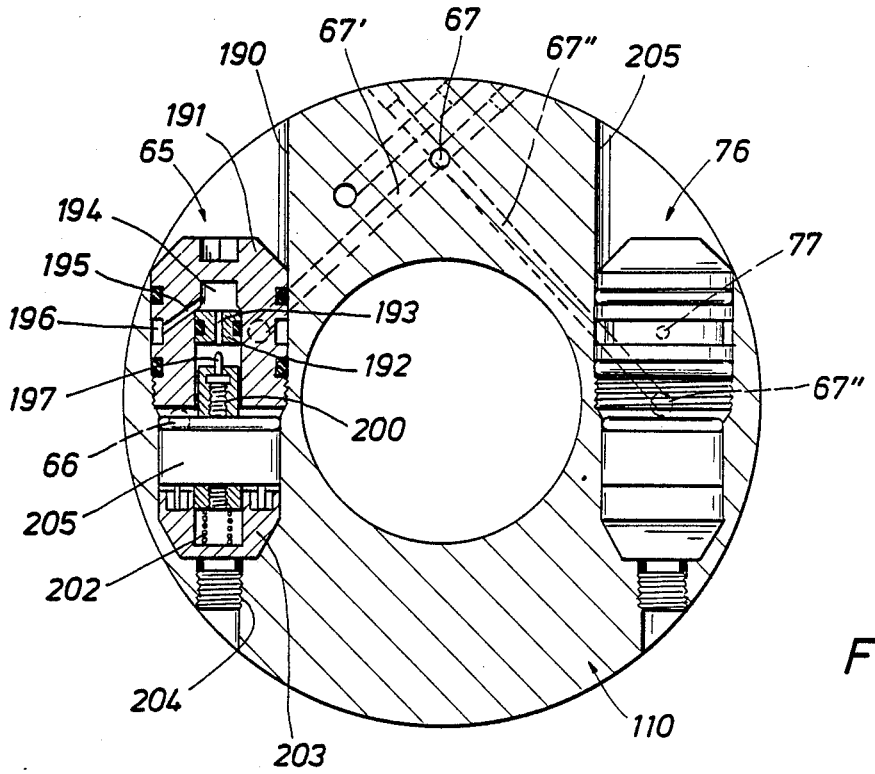

The pair of solenoid valves 65 and 76 that are operatively associated with the pilot valve 68 are mounted in transverse bores 190 and 205 in the wall of the sub 110 as shown in FIG. 7. The valve assembly 65 includes a sealed plug 191 that is threaded into the bore 190 as shown, the plug carrying an annular seat member 192 having a central port 193. The bore 194 of the plug 191 downstream of the port 193 is communicated by a passage 195 with an external annular groove 196 which is intersected by a passage 67' in the valve sub 110, which, as shown, communicates with the passage 67 which leads to the pilot valve 68. O-rings at appropriate locations, as shown, seal against fluid leakage. The seat member 192 cooperates with a valve element 197 on the end of a plunger 200 to prevent flow through the port 193 when the element is forced against the seat member, and to permit such flow when the element is in the open position away from the seat member as depicted in FIG. 7. The plunger 200 is biased toward the seat member 192 by a helical spring 202 that reacts against the base of a conical mount 203 which is threaded into the sub 110 at 204. A coil 205 that is fixed to the mount 203 surrounds the plunger 200 and, when energized by electric current, causes the plunger 200 and the valve element 197 to back away from the seat member 192 to the open position. When the coil 205 is not energized, the spring 202 forces the plunger and valve element to advance to the closed position where a conical end surface of the element engaged a tapered seat surface on the member 192 to close the port 193. The passage 66, as shown in phantom lines, feeds into the bore 190 upstream of the seat ring 192, and the passage 67' leads from the bore area adjacent the groove 196. The passage 66 leads upward in the housing 110 and into open communication with the high pressure chamber 42.

An identically constructed solenoid valve assembly 76 is mounted in a transverse bore 205 on the opposite side of the sub 110 from the assembly 65 as shown in FIG. 7, and therefore need not be described in detail again. The bore 205 is intersected by the passages 67'' and 77 as shown, the passage 67'' being another extension of the passage 67. The passage 67'' intersects the bore 205 at a location upstream of the seat element of the valve assembly 76, whereas the passage 77 intersects the bore adjacent the external annular recess of the valve assembly which is downstream of the seat element. The passage 77 extends upward in the housing 100 to a location in communication with the dump chamber 57 shown in FIG. 5C.

The other pair of solenoid valve assemblies 44 and 53 which are operatively associated with the pilot valve 50 are mounted in bores identical to the bores 190 and 205, but at a different axial level in the sub 110 as shown near the bottom of FIG. 5D. Being identically constructed, these assemblies also are not shown or described in detail to simplify this disclosure. The respective bores in which the assemblies 44 and 53 are mounted are intersected by the passages 43, 47 and 56, 47', respectively, as described generally with reference to FIG. 2. Of course, appropriate electrical conductors lead to the respective coils of each of the solenoid valve assemblies 44, 53, 65, 76 through approximately constructed bores, slots and high pressure feed-through connectors, (not shown) from the solenoid driver board 94 shown schematically in FIG. 3.

The cylinder passage 125 (FIG. 5B) which communicates with the region 126 below the piston 26 leads downwards to another group of control valve components including a pair of pilot valves, each of which is operatively associated with a pair of solenoid valves in the same arrangement as shown in FIG. 2. This group of elements is located in the sub 110 below the group shown near the bottom of FIG. 5D. Hereagain the individual elements are not described in further detail to shorten and simplify the disclosure.

Figure 5E:
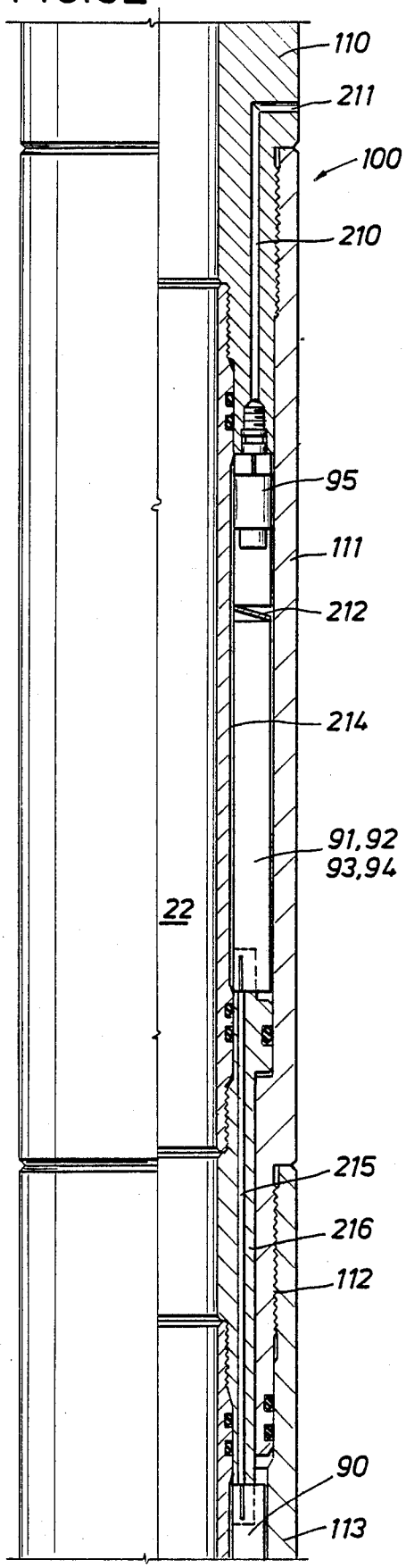
Figure 5F:
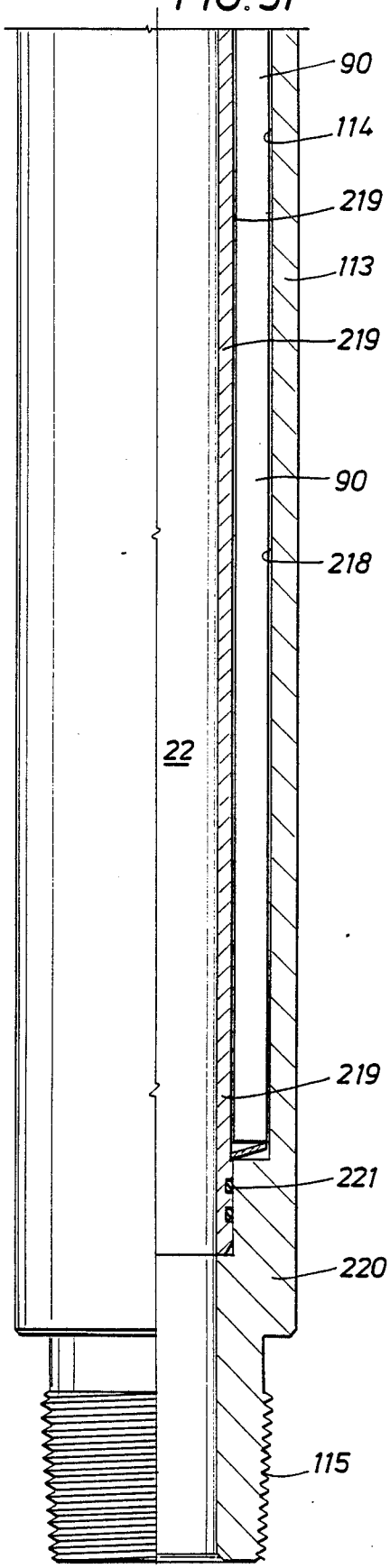

As shown in FIG. 5E, the pressure transducer 95 which is mounted near the lower end of the control sub 110 is communicated with the well annulus 13 outside the housing 100 by a vertical port 210 and a radial port 211, and thus is arranged to sense annulus pressure and to provide an output indicative thereof. An elongated annular cavity 212 is formed between the inner wall of the housing member 111 and the outer wall of a sleeve 214 whose upper end is threaded and sealed to the lower end portion of the sub 110 as shown. The annular cavity 212 receives the various circuit boards 91–94 shown in block diagram in FIG. 3, namely the receiver, controller, driver and power supply boards. Electrical conductors 215 which extend through a suitable channel in a tubular adapter 216 connect the power supply board 91 to one or more storage batteries 90 located in another cavity 218 near the lower end of the tool. The cavity 218, like the cavity 212, is formed between the housing member 113 and the outer wall of a central tube 219. The lower end of the sleeve 214, and the upper end of the tube 219 are threaded and sealed to the adapter 216 as shown. The lower end of the tube 219 is sealed against the lower portion 220 of the housing member 112 by rings 221 as shown in FIG. 5F. The entire housing assembly 100 has a central fluid passageway 22 that extends through the respective bores of the various tubes, sleeves, subs and housing members.

As previously mentioned with reference to FIG. 2, the actuator mandrel 24 is moved downward and upward with respect to the housing 21 in response to selective energization of the solenoid-operated valves. Where the present invention is embodied in a circulating valve 20 that functions to control communication between the passageway 22 and the well annulus 13, the associated valve element can take the form of a sliding sleeve which, as shown in FIG. 5A, is constituted by the upper section 220 of the actuator mandrel 24. The sleeve 220 carries an upper seal ring assembly 221 that, together with the seal ring 30, prevents flow through the side ports 102 in the housing sub 101 when the sleeve and actuator mandrel are in the upper position where the sleeve 220 spans the ports 102. In the lower position of the sleeve 220 and the actuator 24, the ports 102 are opened to fluid flow, so that well fluids can be reverse circulated from the annulus 13 to the tubing or drill stem 12 by applying pressure to the well annulus 13 at the surface. There is positive feed-back of information from downhole that will confirm the opening of the ports 102, since a sudden or abrupt annulus pressure change will occur at the moment the ports open. This pressure change can be sensed at the surface by a suitable device on the pressure supply line 18.

If it is desirable to reclose the ports 102 so that other service work such as acidizing can be done in the well interval below the packer, another sequence of low level pressure pulses is applied at the surface to the annulus 13 via the line 18, which causes the controller 93 to signal the driver 94 to energize the solenoid valves 44 and 76, and to switch off the supply of current to the solenoid valves 53 and 65. When this occurs, the sleeve 220 and actuator 24 are shifted upward in response to high pressure acting on the lower face 34 of the piston 26, as previously described, to position the seal assembly 221 above the ports 102. The circulating valve 20 will remain closed until another command signal having a predetermined signature is applied to the annulus 13 to cause a downward movement of the mandrel 24.

Figure 8:
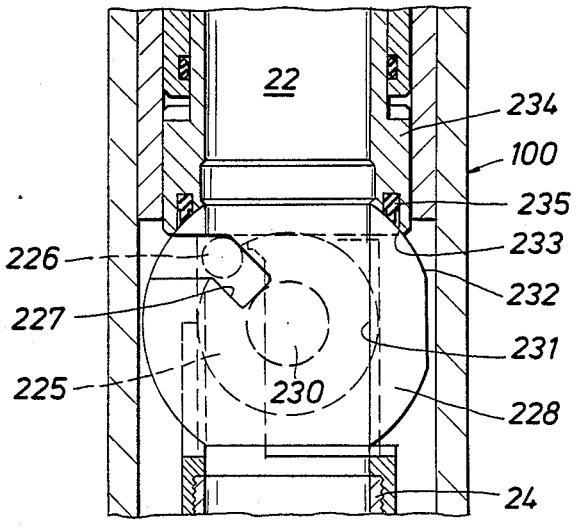
FIG. 8 is a sectional view of a tool string component including a ball valve element which can be used to control formation fluid flow through a central passage of a housing in response to operation of the control system of the present invention.

An embodiment of the present invention where a valve element is employed to control flow of fluids through the central passageway 22 is shown in FIG. 8. Here, the upper end of the actuator mandrel 24 is provided with a pair of laterally offset, upstanding arms 225 that carry eccentric lugs 226 which engage in radial slots 227 in the outer side walls of a ball valve element 228. The ball valve 228 rotates about the axis of trunnions 230 on its opposite sides between an open position where the throughbore 231 of the ball element is axially aligned with the passageway 22, and a closed position where the spherical outer surface 232 thereof engages a companion seat 233 on the lower end of a seat sleeve 234. In the closed position, a composite seal ring assembly 235 prevents fluid leakage. On command as previously described, the mandrel 24 is moved upward and downward to correspondingly open and close the ball element 228. Positive feedback of the position of the ball element 228 is obtained at the surface through appropriate monitoring of pressure in the tubing 11. The use of a ball element 228 provides a valve structure that presents an unobstructed vertical passage through the tools in the open position, so that other well equipment such as string shot, perforating guns and pressure recorders can be lowered through the tool string on wireline. The ball element 228 also provides a large flow area in the open position, which is desirable when testing certain types of wells. The ball element 228 can function as the main test valve, a safety valve, or as a part of a sampler as will be apparent to those skilled in the art.

OPERATION

In operation, the valve and operating system is assembled as shown in the drawings, and the chamber 42 is filled with a suitable hydraulic oil until the floating piston 150 is at the upper end of the chamber as shown in FIG. 5C. The chamber 42 then can be pressurized somewhat to cause the shuttle 60 to open so that the lines 52, 51 and 38 are filled with oil, after which the solenoid valves 44 and 65 are temporarily opened to permit lines 43, 47 and 48, and the lines 66 and 67, to also fill with oil. The dump chamber 57 initially contains only air at atmospheric pressure. The actuator mandrel 24 is in its upper position where the circulating ports 102 are closed off by the mandrel section 220, and is held in such upper position by the return spring 32, if used as shown in FIG. 2. In the actuator embodiment shown in FIG. 5B, the mandrel will remain in the upper position due to seal friction, since the mandrel has an otherwise pressure-balanced design. The assembly 20 then is connected in the tool string, and lowered therewith into the well bore to test depth. As the tools are run, the piston 150 transmits hydrostatic pressure to the oil in the chamber 42, so that oil pressure in the chamber is substantially equal to hydrostatic pressure of fluids in the annulus 13 at all times.

At test depth the tool string is brought to a halt, and the packer 12 is set by appropriate pipe manipulation to isolate the well interval below it from the column of well fluids standing in the annulus 13 thereabove. To initiate a test, the main valve 14 is opened for a brief flow period to draw down the pressure in the isolated interval of the well bore, and then closed for a shut-in period of time during which fluid pressures are permitted to build up as formation fluids hopefully come into the borehole below the packer. The pressure recorders 16, 17 operate to provide chart recordings of pressure versus time elapsed during the test. If desired, suitable known instrumentalities can be used to provide a readout of data at the surface during the test.

To clear the pipe string 11 of formation fluids recovered during the test, the circulating valve 20 is opened in the following manner. A command signal constituted by a series of low level pressure pulses each having a specified duration is applied at the surface via the line 18 to the fluids standing in the well annulus 13. The pressure pulses are sensed by the transducer 95, whose output is coupled to the amplifier or receiver 92. The receiver 92 converts the low level electrical signals from the transducer 95 into an electrical signal having a certain format. The formatted signal is interrogatoried by the controller 93 to determine if electrical signals representing the command signal signature are present, or not. If such is the case, the controller 93 triggers operation of the solenoid driver 99, whereby selected pairs of the solenoid valves are supplied with current. Thus the actuator mandrel 24 is moved upward or downward on command from the surface. With pair 53, 65 engaged, low pressure in the dump chamber 57 is communicated to the rear of the pilot valve shuttle 60, which causes it to shift open, whereby hydrostatic pressure of the oil in chamber 42 is applied to the upper face 40 of the actuator piston 26. Energization of the solenoid valve 65 ensures that pressures are balanced across the shuttle 70 so that its spring 74 retains it closed across the line 73. The difference between hydrostatic fluid pressure and atmospheric pressure thus is applied to the actuator piston 26 which produces downward force to drive the actuator mandrel 24 downward against the bias of the return spring 32. Such movement positions the valve seal assembly 221 below the side ports 102 in the housing 21 and after a suitable time delay to insure complete travel of the mandrel 24, the solenoid valves 53 and 65 are de-energized by the driver 94 in response to signals from the controller 93. Pressure then can be applied to the annulus 13 at the surface cause any fluids in the pipe string 11 to be reverse circulated to the surface where they can be piped to a suitable container for inspection and analysis, or disposed of if desired. If the test is to be terminated at this point, the packer 12 is unseated and the tool string withdrawn from the well so that the pressure recorder charts also can be inspected and analyzed.

If further testing or other service work is to be done without removing the equipment from the well, the circulating valve 20 is reclosed. To accomplish this, another series of low level pressure pulses is applied at the surface to the fluids in the well annulus. Such pulses activate the controller 93 as described above, which causes the driver 94 to energize the other pair of solenoid valves 44, 76. Opening of the solenoid valve 44 equalizes pressures across the pilot valve shuttle 60, so that its spring 63 forces the shuttle closed across the line 51. The solenoid valve 53, when no longer energized, moves to its normally closed position against the seat 55. Opening of the solenoid valve 76 reduces the pressure on the spring side of the pilot shuttle 70, whereby pressure in the line 82 shifts the shuttle to open position where communication is established between line 82 and dump line 73. Of course the solenoid valve 65, when not energized, moves to its normally closed position. The return spring 32 forces the actuator mandrel 24 upward, displacing that volume of oil in the chamber region 36 into the dump chamber 57. By repeated applications of command signals to the fluids in the annulus 13, the circulating valve 20 can be repeatedly opened and closed.

Cycles of downward and upward movement of the actuator mandrel 24 also can be used to rotate the ball element 228 shown in FIG. 8 between its open and closed positions with respect to the flow passage 22. Thus a ball valve in combination with the control system of the present invention can be used as the main test valve 14, or as a sampler safety valve apparatus. Each valve component is the test string can have its own control system, which is operated in response to a command signal having a different signature. Also, one control system can be used to operate a number of different valve components with the driver 94 arranged to control the energization of a plurality of pairs of solenoid valves associated with respective valve components.

Although described in connection with drill stem testing tools, the present invention has application to other well equipment such as firing systems and gun releases used in perforating, packer setting tools, and safety valves, to name but a few devices where longitudinal movement of a mandrel within a housing can be used to activate or control another instrumentality.

Although a command signal comprising one or more low level pressure pulses having a predetermined duration of peak level has been discussed in numerous instances herein, it will be recognized that low level pressure signals having other signatures could be employed. For example the command signal could have a rinse time characteristic, or the composite signal could have a series of time windows, with the presence or absence of a pressure pulse in each of the various windows forming a signature.

It now will be recognized that a new and improved control system for downhole tools has been disclosed. The system responds to low level pressure pulses that are applied to fluids in the well, and thus has application to all types of wells including deep cased hole and open hole (uncased). The power source and command module are contained in the tool, and are arranged for minimum power requirements because of use of normally closed solenoid valves, and the use of downhole hydrostatic pressures to generate force which cause cyclical movement of an actuator. Lengthy operating times are avoided, along with complicated sequences of high pressure applications. The system enables tool designs which are very compact, simple and reliable. Since certain changes or modifications may be made in the disclosed embodiments without departing from the inventive concepts involved, it is the aim of the following claims to cover all such changes and modifications falling within the true spirit and scope of the present invention.

What is claimed is:

1. Apparatus for use in operating a downhole well tool that includes a pressure responsive member which is adapted to be shifted from one position to another position comprising: a pressure responsive surface on said member; and means for supplying a working medium to said surface at a pressure substantially equal to the hydrostatic pressure of well fluid to shift said member from said one position to said other position in response to a comand signal applied to said well fluid, said command signal including at least one low level pressure pulse having a predetermined signature.

2. The apparatus of claim 1 wherein said supplying means includes a high pressure chamber in said well tool adapted to contain a discrete volume of said working medium, and means for transmitting said hydrostatic pressure to said high pressure chamber to pressurize said working medium.

3. The apparatus of claim 2 wherein said supplying means further includes a supply passage leading from said high pressure chamber to said pressure responsive surface, and control valve means operably responsive to said command signal for controlling the flow of said medium through said supply passage.

4. The apparatus of claim 3 further including a low pressure chamber in said well tool adapted to receive a discrete volume of said working medium during shifting of said member back to said one position.

5. The apparatus of claim 4 wherein said control valve means includes first pilot valve means movable between open and closed positions for respectively permitting and terminating flow of said medium through said supply passage.

6. The apparatus of claim 5 wherein said supplying means further includes first solenoid valve means for controlling the position of said first pilot valve means, said pilot valve means having opposite sides and means for biasing said pilot valve means toward said closed position, said first solenoid valve means functioning to either permit said hydrostatic pressure to act on both of said sides of said pilot valve means whereby said pilot valve means is biased to said closed position, or to communicate one side of said pilot valve means with said low pressure chamber whereby hydrostatic pressure acting on the other side of said pilot valve means moves it to said open position.

7. The apparatus of claim 6 wherein said solenoid valve means includes first and second normally closed solenoid valve assemblies, said first solenoid valve assembly being located in a high pressure line that extends from said high pressure chamber to said one side of said pilot valve means, said second solenoid valve assembly being located in a low pressure line leading from said one side to said low pressure chamber, whereby when only said second solenoid valve assembly is energized said pilot valve means moves to said open position, and when only said first solenoid valve assembly is energized said pilot valve is moved by said biasing means to said closed position.

8. The apparatus of claim 7 wherein said member has a piston section, said pressure responsive surface being defined by a first surface of said piston section; cylinder means in said well tool in which said piston section is movable, whereby when said working medium is supplied to said first surface of said piston section, said piston section and member move in one longitudinal direction; means including an exhaust passage for exhausting working medium from said cylinder means when said first pilot valve means is in its closed position; and means for moving said piston section and member in the opposite longitudinal direction as said working medium is so exhausted.

9. The apparatus of claim 8 wherein said moving means is a spring that reacts against a second surface of said piston section.

10. The apparatus of claim 8 wherein said exhaust passage communicates said first surface of said piston section with said low pressure chamber, and further including additional control valve means operably exhaust responsive to said command signal for controlling the exhaust of said medium through said exhaust passage.

11. The apparatus of claim 10 wherein said additional control valve means includes second pilot valve means movable between open and closed positions for respectively permitting and terminating flow of said medium through said exhaust passage to said low pressure chamber.

12. The apparatus of claim 11 wherein said additional control valve means further includes second solenoid valve means for controlling the position of said second pilot valve means, said second pilot valve means having opposite sides and means for biasing said second pilot valve means toward its closed position, said second solenoid valve means functioning to either permit said hydrostatic pressure to act on both of said sides of said second pilot valve means whereby said biasing means closes said second pilot valve means, or to communicate one side of said second pilot valve means with said low pressure chamber whereby hydrostatic pressure acting on the other side thereof moves said second pilot valve means to said open position.

13. The apparatus of claim 12 wherein said second solenoid valve means includes third and fourth normally closed solenoid valve assemblies, said third solenoid valve assembly being located in a second high pressure line extending from said high pressure chamber to said one side of said second pilot valve means, said fourth solenoid valve assembly being located in a second low pressure line leading from said one side of said second pilot valve means to said low pressure chamber, whereby when only said fourth solenoid valve assembly is energized said second pilot valve means moves to said open position, and when only said third solenoid valve assembly is energized said second pilot valve means is moved by said biasing means to said closed position.

14. The apparatus of claim 1 further including sleeve valve means on said member and movable therewith; said well tool including a housing having port means for communicating the interior of said housing with the well annulus outside said housing, said sleeve valve means being arranged in said one position to span and close off said port means and in said other position to open said port means to permit circulation of well fluids via said port means between the interior and exterior of said housing.

15. The apparatus of claim 1 further including ball valve means coupled to said member, said well tool including a housing having a flow passage therein, said ball valve means being arranged to pivot about an axis that is transverse to said flow passage between a closed position with respect to said passage when said member is in said one position and an open position with respect to said flow passage when said member is in said other position.

16. The apparatus of either claim 11 or claim 12 wherein said member is a tubular mandrel said having an outwardly directed flange that provides piston means thereon, said piston means having opposite sides, one of said sides providing said pressure responsive surface.

17. The apparatus of claim 16 further including means acting on the other of said sides of said piston means for returning said mandrel to said one position when the hydrostatic pressure acting on said one side of said piston means is reduced.

18. The apparatus of claim 1 wherein said supplying means comprises a high pressure chamber in said well tool arranged to contain said working medium and a low pressure chamber in said well tool arranged to receive an exhaust of said working medium, and control valve means for alternately supplying working medium from said high pressure chamber to act on said pressure responsive surface and exhausting working medium to said low pressure chamber after said medium has acted on said pressure responsive surface.

19. The apparatus of claim 18 further including sensor means on said well tool for detecting said command signal and providing an output indicative thereof, controller means for interrogating said output to determine the presence or absence of said signature, said controller means including means for triggering operation of said control valve means only when said signature is present.

20. The apparatus of claim 19 wherein said control valve means includes a plurality of solenoid valve assemblies, and further including driver means coupled between said controller means and said solenoid valve assemblies for energizing selected ones of said plurality of solenoid valve assemblies when triggered by said controller means.

21. The apparatus of claim 20 further including power supply means in said well tool for operating said controller means, each of said solenoid valve assemblies being a normally closed device to reduce power output requirements of said power supply means.

22. The apparatus of claim 19 wherein said sensor means includes transducer means for sensing said command signal and providing an output indicative thereof, said controller means functioning to trigger operation of said control valve means when said output includes a characteristic which indicates that the time period of the peak value of said pressure pulse exceeds a predetermined minimum time period.

23. A method of controlling the operation of a downhole well tool having a pressure responsive member which is adapted to be shifted from one position to another position, said member having pressure responsive surface means, comprising the steps of: applying a command signal to fluids in the well, said command signal including at least one low level pressure pulse having a predetermined signature; detecting said command signal at said well tool; and supplying a working medium at a pressure substantially equal to hydrostatic pressure to said pressure responsive surface means in response to detection of said command signal to shift said pressure responsive member from said one position to said other position.

24. The method of claim 23 including the further step of opening a valve in said well tool in response to shifting of said pressure responsive member.

25. The method of claim 24 wherein said valve is a circulating valve that controls fluid communication between the interior and the exterior of said well tool.

26. The method of claim 24 wherein said valve is a valve element that controls fluid flow through a passage within said well tool.

27. The method of claim 23 wherein said well tool is suspended in the well bore on a pipe string, there being an annulus between said pipe string and the surrounding well bore wall, said command signal being applied at the surface to well fluid standing in said annulus.

28. A method of controlling the operation of a downhole well tool having a pressure responsive member which is adapted to be shifted from one position to another position, said member having pressure responsive surface means, comprising the steps of: applying a command signal to fluids in the well, said command signal comprising a series of at least two level pressure pulses having a predetermined signature, said signature being a detectable physical quantity of said series of pressure pulses; detecting said command signal at said well tool; and supplying a working medium under pressure to said pressure responsive surface means in response to detection of said command signal to cause shifting of said pressure responsive member from said one position to another position.

29. The method of claim 28 wherein said detectable physical quantity is of time period of the peak value of each of said pressure pulses.

30. The method of claim 28 wherein said detectable physical quantity of said series of pressure pulses is whether or not a pressure pulse is present in each of a sequence of discrete time intervals that constitute the total time of transmission of said command signal.

31. The method of claim 28 including the further steps of: applying another command signal to fluids in the well, said other command signal comprising another series of pressure pulses having a predetermined signature at least similar to said first-mentioned command signal; detecting said other command signal at said well tool; and returning said pressure reponsive member to said one position in responsive to detection of said other command signal.

32. The method of claim 31 wherein said returning step includes exhausting said working medium to a low pressure chamber in said well tool.

33. The method of claim 28 including the further step of opening a valve in said well tool in response to shifting of said pressure responsive member from said one position to another position.

34. The method of claim 33 wherein a fluid circulating passage in opened to communicate the interior of said well tool with the exterior thereof in response to shifting of said member from said one position to said other position.

35. The method of claim 33 wherein a central flow passage in said well tool is opened to permit a flow of well fluids therethrough in response to shifting of said member from said one position to said other position.

36. The method of claim 31 wherein a fluid circulating passage is closed prevent communication between the interior and exterior of said well tool in response to return of said member to said other position.

37. The method of claim 31 wherein a central flow passage in said well tool is closed to prevent flow of well fluids therethrough in response to return of said member to said other position.

38. A method of controlling the operation of a downhole formation testing tool that is suspended in a well bore on a pipe string, said testing tool including valve means arranged to be opened and closed in response to shifting of an actuator mandrel in opposite longitudinal directions, said actuator mandrel having pressure responsive surface means, comprising the steps of: applying a command signal to fluids in the annulus externally of said pipe string, said command signal including at least one low level pressure pulse having a predetermined signature; detecting said command signal and providing an electrical signal representative thereof; interrogating said electrical signal to determine the presence of said command signal; shifting said actuator mandrel in one of said longitudinal directions where said interrogating step indicates that said command signal is present; and opening said valve means in response to said shifting step.

39. The method of claim 38 including the further steps of: applying another command signal as defined in claim 38 to fluids in said annulus, detecting said other command signal and providing another electrical signal representative thereof; interrogating said other electrical signal to determine the presence of said other command signal; shifting said actuator mandrel in the other of said longitudinal directions when said last-mentioned interrogating step indicates that said other command signal is present; and closing said valve means in response to said last-mentioned shifting step.

40. The method of either claim 38 of claim 39 wherein said shifting step is a result of applying a pressure substantially equal to the hydrostatic pressure of well fluids adjacent said testing tool to said pressure responsive surface means.

41. The method of claim 38 wherein said formation testing tool defines a high pressure chamber containing a working medium, said pressure responsive surface means having opposite sides, and including the further steps of: equalizing the pressure of said working medium with the hydrostatic pressure of well fluids adjacent said testing tool; and supplying said pressurized working medium to act on one of said sides of said pressure responsive surface means to cause said shifting of said actuator mandrel to occur.

42. The method of claim 41 wherein said formation testing tool defines a low pressure chamber, and including the further step of exhausting working medium from the opposite one of said sides of said pressure responsive surface means to said low pressure chamber as said shifting of said actuator mandrel occurs.

43. The method of claim 42 including the further steps of: applying another command signal as defined in claim 38 to fluids in said annulus; detecting said other command signal and providing another electrical signal indicative thereof; interrogating said other electrical signal to determine the presence of said other command signal; shifting said actuator mandrel in the other of said longitudinal directions when said last-mentioned interrogating step indicates that said other command signal is present; and opening said valve means in response to said last-mentioned shifting step.

44. The method of claim 43 including the further steps of: supplying working medium from said high pressure chamber to said opposite one of said sides of said pressure responsive surface means to cause return shifting of said actuator mandrel; and exhausting working medium previously supplied to said one side of said pressure responsive surface means to said low pressure chamber while working medium is being applied to said opposite one of said sides of said pressure responsive surface means.

* * * * *